US007347642B1

(12) United States Patent
Showen

(10) Patent No.: US 7,347,642 B1
(45) Date of Patent: Mar. 25, 2008

(54) CIRCULAR SUBDIVISIONS PARKING/BIKING LANE, ELIMINATION OF STORM DRAINS, AND WALKABLE COMMUNITY DEVELOPMENT PROVISIONS

(76) Inventor: Robert Harrison Showen, 1409 Ptarmigan Dr. #2, Walnut Creek, CA (US) 94595-4137

( * ) Notice: Subject to any disclaimer, the term of this patent is extended or adjusted under 35 U.S.C. 154(b) by 0 days.

(21) Appl. No.: 11/655,030

(22) Filed: Jan. 18, 2007

(51) Int. Cl.
*E01C 1/00* (2006.01)

(52) U.S. Cl. ..... 404/1; 52/169.3

(58) Field of Classification Search ..... 404/1; 293/133; 52/169.1–169.3
See application file for complete search history.

(56) References Cited

U.S. PATENT DOCUMENTS 1,543,080 A * 6/1925 Graves ..... 404/1
3,272,097 A * 9/1966 Gazis et al. ..... 404/1
3,533,062 A * 10/1970 Coffman ..... 340/907
3,945,745 A * 3/1976 Chang ..... 404/1
4,272,210 A * 6/1981 Shoji et al. ..... 404/1
4,398,842 A * 8/1983 Hodson ..... 404/82
6,470,633 B2 * 10/2002 Showen ..... 52/169.1

* cited by examiner

*Primary Examiner*—Raymond W Addie

(57) ABSTRACT

A walkable community subdivision is provided with a plurality of traffic circles. Each traffic circle can contain one or more playgrounds or parks. A plurality of development circles containing one or more buildings or playgrounds. The outer circles of the subdivision are graded toward a center of the community such that storm water run-off is directed to a center circle, which has a storm water storage capacity. Thus eliminating the use of storm water drainage pipes in the community.

15 Claims, 4 Drawing Sheets

CIRCULAR SUBDIVISIONS PARKING/BIKING LANE, ELIMINATION OF STORM DRAINS, AND WALKABLE COMMUNITY DEVELOPMENT PROVISIONS

CROSS-REFERENCE TO RELATED APPLICATIONS

U.S. Pat. No. 6,470,633 B2, dated Oct. 29, 2002, entitled Circular Subdivisions, issued to this Applicant. This prior Patent should be reviewed with the review of this application because this application deals with amplifications of the concepts described in the prior Patent.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The field of endeavor to which my invention pertains is real estate subdivision and development, with references to appropriate residential, office, commercial and industrial construction techniques.

I previously hired a patent search company to investigate prior art and they concluded that the following U.S. patents were most relevant to my disclosure:

U.S. Pat. No. 4,679,363 discloses a township, city and regional land arrangement with housing and commercial buildings having a plurality of circular roadways.

U.S. Pat. No. 4,920,711 discloses a building construction system which is arranged in four 90 degree quadrants.

U.S. Pat. No. 4,852,313 discloses a building arrangement and method for view site; said arrangement maximizes the number of houses with a line of site to a view.

None of the foregoing patents, however, remotely approximate the combination of development circles, surrounded by traffic circles, all connected together by a pattern of one-way streets, the subject matter of my prior Patent and this application.

BRIEF SUMMARY OF THE INVENTION

Although reference was made to condominiums in the prior Patent, most comments dealt with detached or attached single-family residences. This application is based upon the recognition that the principal use of Circular Subdivisions may be for entire walkable communities. In the prior Patent, the parking lanes did not extend into the traffic circles or beyond them. In this application, the parking lanes have been converted into combination parking and bicycle lanes that extend into the development circles, the traffic circles, the entries, the exits and the arterial service roads and traffic circles outside the Bobstown Villages development (FIG. 3).

DETAILED DESCRIPTION OF THE INVENTION

1. The Concept

My original objections and solutions in the prior Patent dealt primarily with detached and attached (technically zero lot line) single-family residences. Before long I realized that the zero lot line residences depicted in the application for my prior Patent could easily be extended in each of the four perpendicular directions to provide construction space for sixteen true two-story condominiums on the same development circle housing only four zero lot line residences.

Ultimately I realized that our housing problems were much broader and began to think about prevention of urban sprawl, affordability of housing, bicycle safety, and environmental and health issues such as air and river pollution, water conservation, global warming, and inactivity and obesity problems of adults and children. Each of the eight substantive issues described in the preceding sentence are discussed separately in the following numbered paragraphs.

2. Prevention of Urban Sprawl

Many jurisdictions are now trying to prevent further urban sprawl by surrounding existing cities with urban development boundaries that require future development to take place in existing cities. These urban development boundaries do have a temporary effect of preventing developments in adjacent farms, ranches, etc., but before long the problems that caused residents to flee the cities in first place, i.e., inadequate schools, inadequate transportation, inadequate parking, and inadequate parks and recreation areas, cause the urban development boundaries to be amended and often replaced, unfortunately, by further urban sprawl developments.

Figure 3:
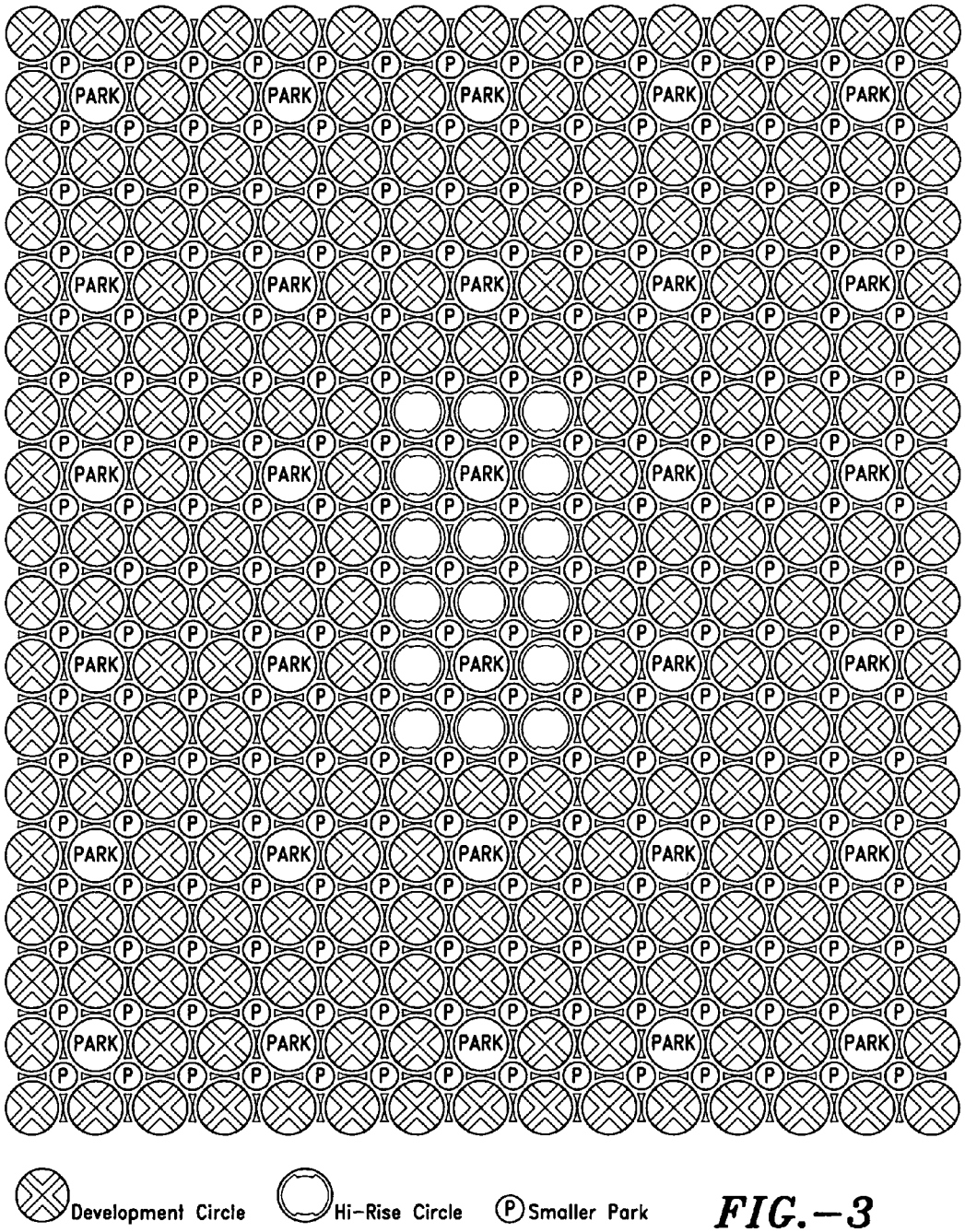
FIG. 3—Depicts an entire walkable community, Bobstown Villages, for about 20,000 residents, all of whom are only a short walk (no more than one-quarter mile) from their private or government offices, stores, theaters, high-rise residential condominiums, restaurants, parking garages, hospitals, schools, churches, etc., in the center of the community.

Recognizing a few exceptions such as developments of large homes for wealthy individuals surrounding a golf course, further urban sprawl developments should not be built in existing cities or in their adjacent farms, ranches, etc. Further developments need to be compact, efficient, affordable and safe, as shown in the Bobstown Villages development (FIG. 3).

I recently did a study for a project near Denver, Colo. The existing population of Denver is spread over an area of a little less than 160 square miles. By using the concepts depicted in the Bobstown Villages (FIG. 3), that same entire population of Denver could live and work in an area of about 16 square miles, a reduction in required land use of almost 90%.

3. Affordability of Housing

From a development standpoint each development circle will yield about four single-family detached homes per acre, about sixteen condominium homes per acre (all with attached enclosed garages), or one high-rise building for residential, or office or commercial purposes. At this time when affordable housing and loss of open space rank highest among the concerns of both public officials and private citizens, this subsequently discussed ability to produce fourteen to sixteen attractive two-story condominium homes per acre surrounded by 75% open space probably will be one of the most important uses of Circular Subdivisions.

Figure 4:
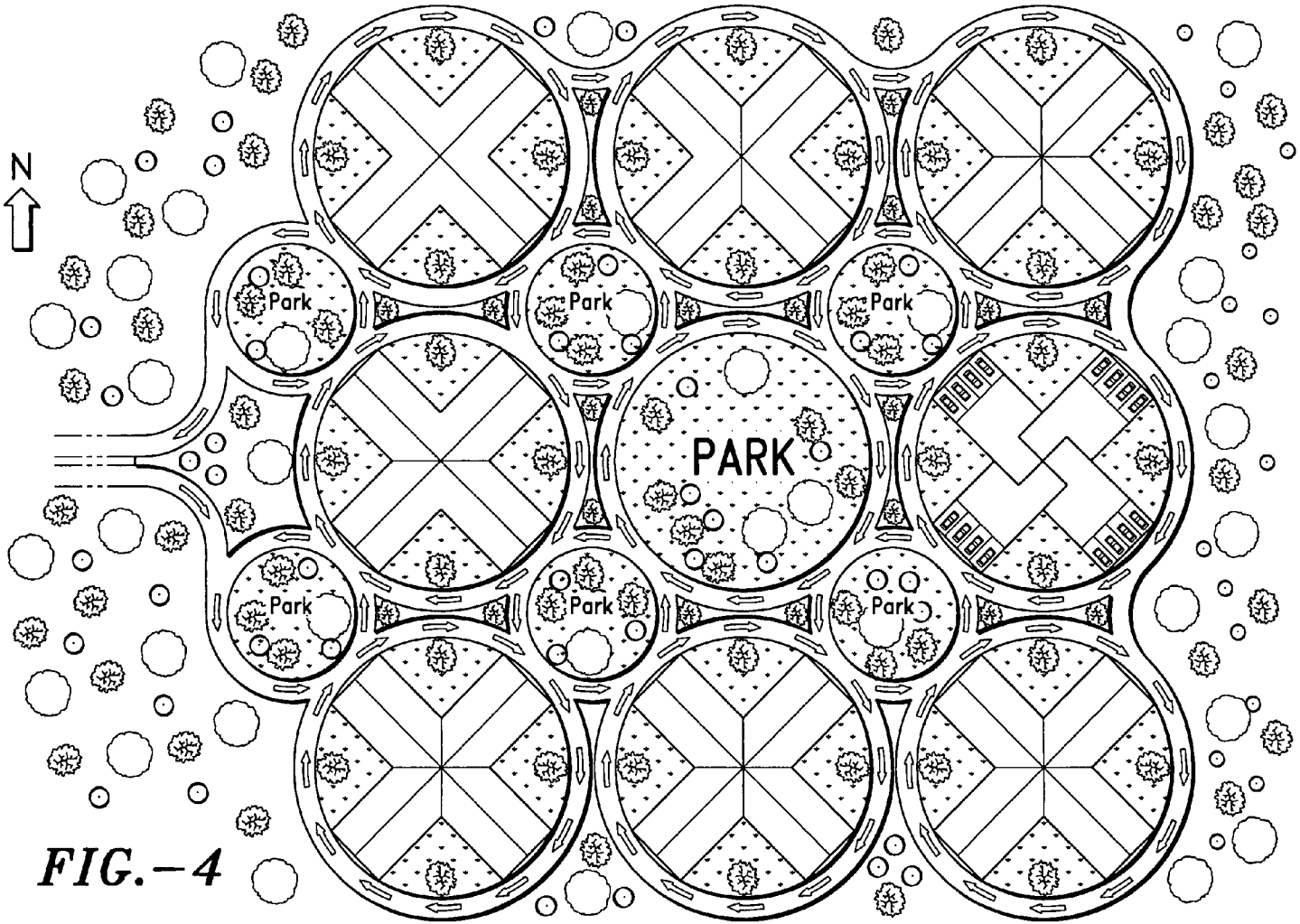
FIG. 4—Depicts a typical Circular Subdivision two-story residential condominium area with one large park and four smaller parks in the center. These represent the twenty-eight low-rise residential areas in the Bobstown Villages development (FIG. 3) that surround the high-rise downtown area in the center of the community.

Although the condominiums surrounding the park depicted in FIG. 4 are only two stories tall the population density is about the same that exists in New York City, i.e., more than 25,000 residents per square mile. However, the Bobstown Villages development (FIG. 3) low-rise condominiums are surrounded by about 50% recreational parks and other landscaped areas while the tall buildings in New York City have only about 17% or 18% recreational parks and other landscaped areas (mostly concentrated in one Central Park).

Having such an abundance of landscaped areas immediately available for exercise and play (FIG. 4) is a tremendous advantage for the Bobstown Villages development (FIG. 3) low-rise condominiums at a time when inactivity and obesity are serious national problems in the United States for both adults and children. The larger park in the center of the 128 low-rise residential condominiums is of sufficient size to accommodate such sports as soccer, lacrosse, field hockey, flag football, and in colder areas even ice-skating. The smaller parks in the center, and around the edges, of the 128 low-rise residential condominiums will accommodate such activities as sand boxes for small children and their parents, volleyball, badminton, horseshoes, etc.

Consistent with the Bobstown Villages development's (FIG. 3) underlying concept of creating neighborhoods in which residents get to know their neighbors, the cut-in system will be used to eliminate long waiting times in the recreational park areas described in the preceding paragraph. For example, a full complement of six players on each side are involved in a volleyball game. During the game, four newcomers arrive and wait. At the end of the game, the captain of the losing team has the first pick and the captain of the winning team has the second pick, until all four newcomers have been chosen to replace the two players on each team who have been playing for the longest time. The four replaced players are then treated as newcomers at the end of the next game. This assures that no player will have to sit out for very long.

Because of the circular configurations of the development circles, the traffic circles, and the combination bicycle and parking circles, the eight 1,000 square foot two bedroom, two bath lower floor condominiums, and the eight 1,500 square foot three bedroom, three bath upper floor condominiums, that are contained in each development circle (FIG. 4), provide attractive affordable housing with an unheard of amount of open space, but, at the same time, reduce the loss of open space in the surrounding area because the Circular Subdivision condominiums around a park plan requires the development of only 25% of the open space that would be required to develop a conventional detached home rectangular subdivision housing the same number of residents, thus leaving 75% of the surrounding open space to continue to be used for agriculture, forestry, ranching, etc.

The basic idea in the Bobstown Villages development (FIG. 3) is that there are a number of neighborhoods in increasing sizes. Each of the four pie-shaped lawn areas surrounding the low-rise condominiums is a neighborhood for four families. Each module of low-rise condominiums is a neighborhood for one hundred twenty-eight families. Each 270-acre Bobstown Villages development (FIG. 3) is a neighborhood for almost five thousand families.

4. Bicycle Safety Provisions

My application for the original Circular Subdivision patent made no reference to bicycle lanes of any sort. Even the automobile parking lanes surrounded only the development circles, not the traffic circles or beyond. As the other substantive issues in these numbered paragraphs were considered, bicycles and bicycle safety became an essential ingredient in the mix and were made possible by the elimination of automobiles as the main means of transportation.

In fact, one of my studies concluded that, by using the concepts in the Bobstown Villages development (FIG. 3), an area six miles wide and six miles deep (easy distances for bicycles) would be large enough to employ a sizable part of, and house all of, over one million residents.

Figure 1:
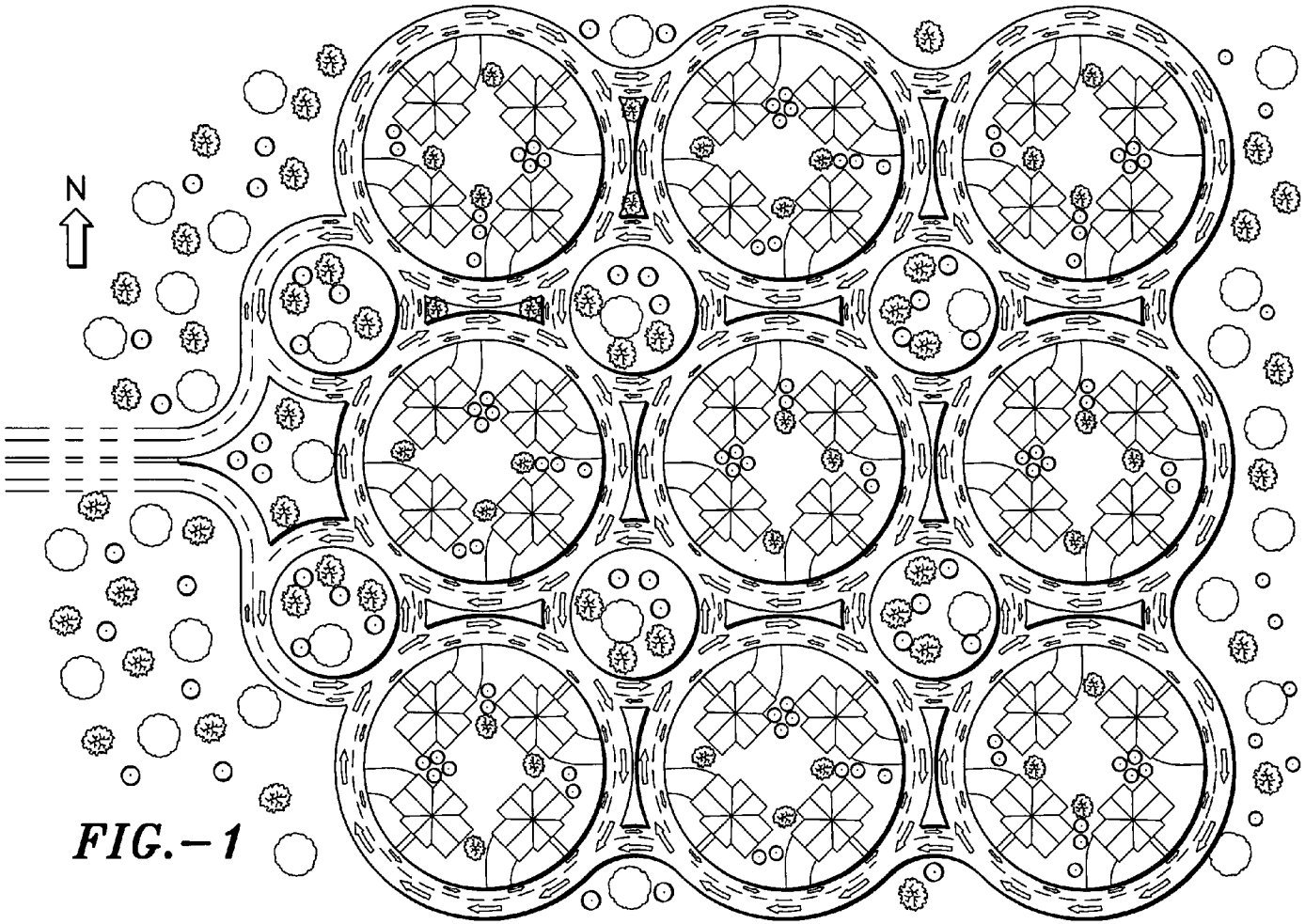
FIG. 1—Depicts Circular Subdivision detached single-family residences with the auto traffic in the automobile lanes and the bicycle traffic in the combination parking and bicycle lanes, each proceeding in opposite directions.
Figure 2:
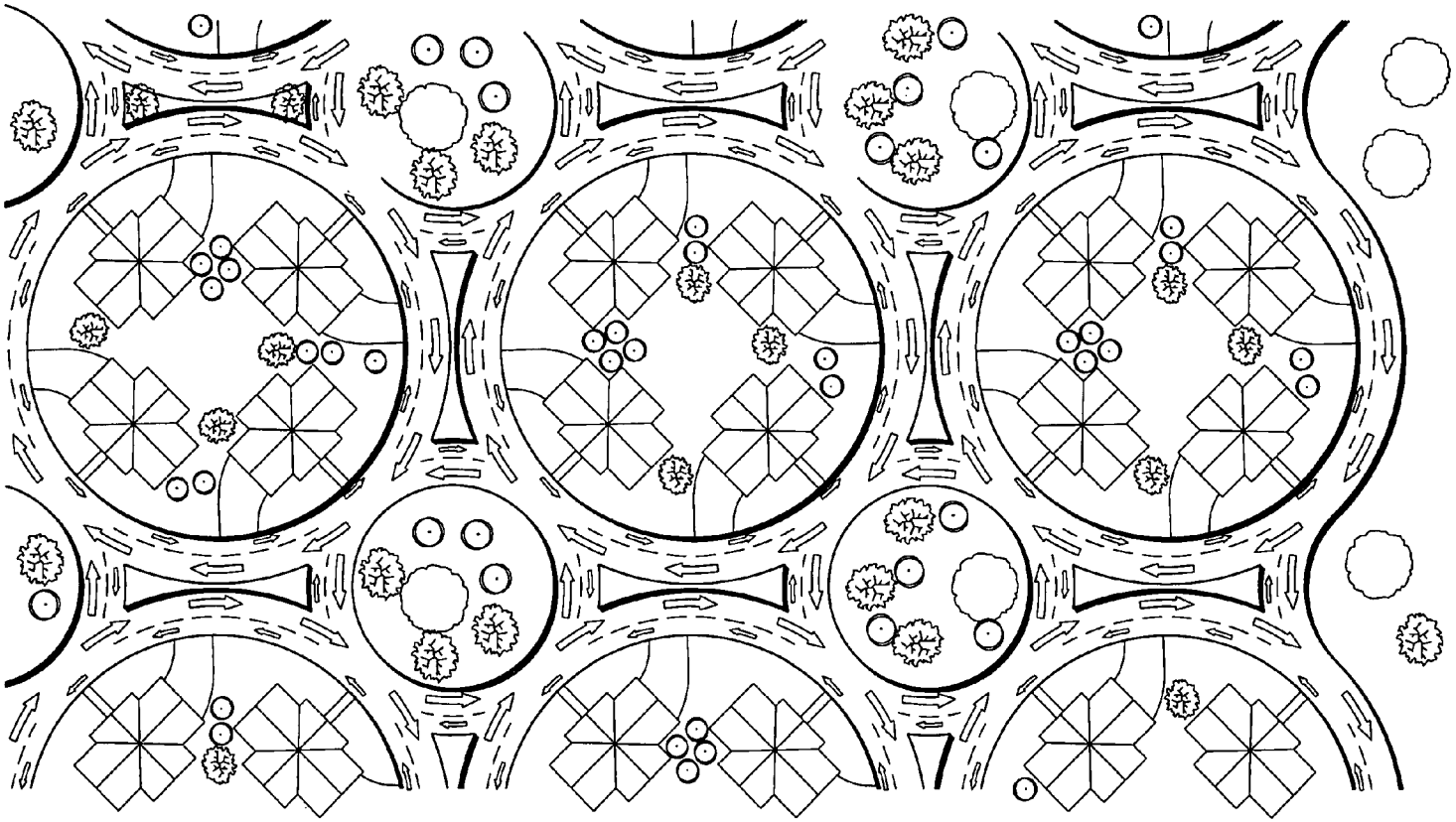
FIG. 2—Depicts only the central row of the development circles on FIG. 1, making the traffic arrows easier to read.

FIG. 1 depicts Circular Subdivision detached single-family residences with the auto traffic in the automobile lanes and the bicycle traffic in the combination parking and bicycle lanes, each proceeding in opposite directions. FIG. 2 depicts only the central row of the development circles on FIG. 1, making the traffic arrows easier to read. Combining automobile traffic and bicycle traffic creates serious problems for both the auto driver and the cyclist.

Today most jurisdictions have any bicycle lane parallel to, and to the right side of, the automobile lane, with the traffic in both lanes proceeding in the same direction. The auto driver cannot be certain that the cyclist has seen the auto until the auto is already past the bicycle. The cyclist cannot be aware of the auto until it appears in the dentist's tooth-mirror that is glued to the cyclist's helmet or the cyclist has heard the noise of the auto's engine as it is whizzing past.

Likewise, I propose to have the combination bicycle and parking lane parallel to, and to the right side of, the automobile lane, but with the traffic in the automobile lane proceeding in one direction and the bicycle traffic in the combination bicycle and parking lane proceeding in the opposite direction. In either daytime or nighttime with lights on, this gives both the auto driver and the cyclist a better opportunity to see that they are approaching each other. Also in nighttime with lights on, this gives the cyclist the opportunity to give a hand signal to the auto driver to lower the auto's headlights from high beam to low beam.

My proposed system for combining automobile traffic and bicycle traffic would apply to not only the development circles but also to the traffic circles, the entries, the exits and the arterial service roads and traffic circles outside the Bobstown Villages development (FIG. 3).

I believe my proposed system for combining automobile traffic and bicycle traffic is preferable to our existing system, but if some jurisdictions insist upon the old rules of having automobiles and bicycles going the same direction, my new proposed road systems will remain unchanged. It is only necessary to reverse the painting of the arrows in the bicycle lanes to match the direction of the arrows in the parallel automobile lanes.

5. Reduction of Air Pollution

Air pollution is reduced because residents are almost required, by the design of the Bobstown Villages development (FIG. 3), to walk or ride a bicycle rather than to drive an automobile. Who needs to drive an automobile if it is less than a quarter of a mile from the resident's home to the resident's office?

Examples of higher densities and mixed uses are set forth on the Bobstown Villages development (FIG. 3), a 270-acre theoretical project. In this particular configuration, two modules of commercial (and residential) high-rise development are surrounded by twenty-eight modules of low-rise residential condominium development. The commercial development modules would consist of private or government offices, stores, theaters, high-rise residential condominiums, restaurants, parking garages, hospitals, schools, churches, etc. The most distant residents in the more affordable low-rise condominiums are less than one-quarter of a mile from the commercial area, and the residents of the more expensive high-rise condominiums are right in the middle of the commercial area.

The secret, of course, is to balance the jobs with the residences. For illustration purposes, I assumed there would be fourteen 15-story buildings, seven residential buildings and seven commercial buildings. This resulted in an estimated 1,260 dwelling units in the high-rise area. Four development circles in the two modules of high-rise development have been converted into larger parks. Ten traffic circles in the two modules of high-rise development have been converted into smaller parks. These fourteen parks in the center of the high-rise development modules are discussed further in paragraph 9 (Reduction in Inactivity and Obesity Problems).

To emphasize the problem that lower paid employees are least able to purchase homes, I allocated most of the 270-acres in the project to the more affordable low-rise residential condominiums. This resulted in an estimated 3,584 (28×128) dwelling units in the low-rise area, and a total of 4,844 (1,260+3,584) dwelling units (almost 18 dwelling units per acre) plus the job support services (1,785,000 square feet of office and commercial space) for the residents in the entire 270-acre project.

6. Reduction of Stream, River and Bay Pollution

Oil-based asphalt streets and storm drains required by governmental entities are probably the main causes of stream, river, bay and ocean pollution. So far the main prevention effort espoused by these governmental entities is to paint above the entry drains a sign like "DO NOT DUMP—FLOWS INTO THE BAY". These signs are somewhat ironic because their implied meaning is that private individuals should not pollute, only governmental entities may pollute.

Neither private individuals nor governmental entities should pollute. Reduction of stream, river, bay and ocean pollution can be achieved in Circular Subdivisions by grading downward from the development circles into the larger and smaller parks and other planted areas and by using pervious concrete or pervious asphalt for sidewalks and roads similarly graded, thereby eliminating the need for storm drains in most geographic areas. The necessity for grading, or the angle of the grading, when necessary, will be determined by the porosity of the soils, and the amount and the intensity of the rainfall, in the particular area being developed.

7. Water Conservation

Particularly in the Western States of the United States, water conservation is a major political issue. In many jurisdictions landscaping is limited to drought-resistant native plants, usually resulting in prohibitions against planting grass in lawns or playgrounds. These prohibitions against planting grass are directly contrary to the solutions discussed in paragraph 9 (Reduction in Inactivity and Obesity Problems).

The Bobstown Villages development (FIG. 3) resolves this conflict by providing for both water conservation and the reduction in inactivity and obesity problems. Fresh water will be used twice. There will be two distinct water distribution systems, one for potable water and another for non-potable water. The fresh potable water will be distributed to the various residential, office and commercial users, and then their effluents will be collected and treated by a waste-water treatment plant and the resulting non-potable water will be used to irrigate the landscaped areas, including the grass lawns and playgrounds.

8. Reduction in Global Warming

The principal contribution to a reduction in global warming will result from the lessening of reliance on automobiles and the substitution of walking and bicycle riding. Since there is a maximum distance of one-quarter mile from a resident's home to a resident's workplace, church, school, private or government offices, stores, theaters, restaurants, hospitals, etc., there is a minimal need for automobile travel.

A major contribution to a reduction in global warming will result from the substitution of pervious concrete or pervious asphalt for regular asphalt in all roads and sidewalks, and from the elimination of outdoor parking lots in the commercial development modules. Parking lots in the commercial development modules will be housed in certain of the high-rise buildings in the commercial development modules.

9. Reduction in Inactivity and Obesity Problems

There is no question that many adults and children in the United States have problems of inactivity and obesity. The worst example, however, appeared in the Nov. 24-26, 2006 weekend edition of the San Francisco Daily that reported:

> "Not a single ninth grader tested in San Francisco's public schools could achieve adequate performance in all six categories of the state's physical fitness exam, according to the California Department of Education."

In this city of almost 800,000 residents, this result is almost inconceivable.

The Bobstown Villages development (FIG. 3) seeks to reduce inactivity and obesity problems of both adults and children. As previously explained in Paragraph 5 with respect to the two commercial modules in the center of the Bobstown Villages development (FIG. 3), each of the four larger parks in the center is of sufficient size to accommodate such sports as soccer, lacrosse, field hockey, flag football, and in colder areas even ice-skating. Each of the ten smaller parks in the center will accommodate such activities as sand boxes for small children and their parents or teachers, volleyball, badminton, horseshoes, etc.

During school hours, all of the fourteen parks could be used primarily for the students of the schools and their parents or teachers. After 5:00 p.m., all of the fourteen parks could be used primarily for the tenants of the office buildings to engage in intramural sports. Today there is hardly a company that does not have employee T-shirts with the company's logo and products printed on the back. A company could compete in intramural sports with their competitors, perhaps more broadly defined to include the company's attorneys, accountants, insurance agents, suppliers, etc. After the intramural game is over it is quite likely that the employees and their "competitors" will go across the street for a light malt beverage and some pizza. Intramural sports, particularly co-ed intramural sports, are a great way for employees to meet other employees and their "competitors".

I have intentionally omitted to provide for industrial land in the Bobstown Villages development (FIG. 3). I realize that some of it is necessary, but it does not need to proliferate in every community. As a nation we are trending toward a work force of service people. If walkable communities such as I have proposed can have residents live, work, worship, learn, be entertained, etc. without having to drive their cars, we do not have to worry if a resident occasionally has to drive away several miles to purchase goods or services.

BEST MODE OF CARRYING OUT INVENTIONS

As stated in the application for the original Circular Subdivisions patent issued to me on Oct. 29, 2002, I did not intend to develop any CIRCULAR SUBDIVISIONS myself. The best mode then contemplated by me of carrying out my inventions was to enter into non-exclusive license agreements with both small and large capable professional residential, office, commercial and industrial developer-builders.

Unfortunately, before long I was advised that the National Association of Home Builders had concluded that the USPTO should not issue patents relating to land development or home building and had further adopted a policy against their member-builders entering into licensing agreements with United States patent holders having patents relating to land development or home building. Later I met in Washington, D.C. with the Manager, and one of his Assistants, of the Home Building Office of the U.S. Department of Housing and Urban Development. They both seemed very interested in the use of Circular Subdivisions as a means of providing affordable housing, and they scheduled another meeting with me a couple of days later to discuss the subject further. At this subsequent meeting they were very apologetic. They had discussed this matter with staff members at the National Association of Home Builders, had been advised about the Association's policy against patents relating to land development or home building, and had been warned that, if HUD became involved with Circular Subdivisions, the Association, or its member-builders, would discontinue their previous charitable activities of providing housing for low-income individuals.

I have neither the financial ability nor the life expectancy to attempt to upset the Association's policy against the USPTO issuing patents relating to land development or home building. If the legal department of the USPTO desires to do so, I would be willing to be a witness.

In view of the negative policy of the National Association of Home Builders, the best mode now contemplated by me of carrying out my inventions would be first to enter into non-exclusive license agreements with capable professional residential, office, commercial and industrial developer-builders that are not bound by the negative policy of the National Association of Home Builders, and (as a last resort) to attempt personally to develop an example of the Bobstown Villages walkable community subdivision covered by this Application (using qualified independent engineers, architects, contractors, etc. to perform the work).

DRAWINGS

FIG. 1—Depicts Circular Subdivision detached single-family residences with the auto traffic in the automobile lanes and the bicycle traffic in the combination parking and bicycle lanes, each proceeding in opposite directions.

FIG. 2—Depicts only the central row of the development circles on FIG. 1, making the traffic arrows easier to read.

FIG. 3—Depicts an entire walkable community, Bobstown Villages, for about 20,000 residents, all of whom are only a short walk (no more than one-quarter mile) from their private or government offices, stores, theaters, high-rise residential condominiums, restaurants, parking garages, hospitals, schools, churches, etc., in the center of the community.

FIG. 4—Depicts a typical Circular Subdivision two-story residential condominium area with one large park and four smaller parks in the center. These represent the twenty-eight low-rise residential areas in the Bobstown Villages development (FIG. 3) that surround the high-rise downtown area in the center of the community.

The invention claimed is:

1. A walkable community subdivision system providing alternating one-way traffic on all subdivision streets, said system comprising;

a plurality of traffic circles, each traffic circle containing one or more playgrounds or parks, each traffic circle having an inner traffic lane and an outer combination parking and bicycle lane surrounding the traffic circle, a plurality of development circles, each development circle containing one or more buildings or playgrounds or parks, each development circle having an inner combination parking and bicycle lane, and an outer traffic lane, surrounding the development circle, the rotational direction of traffic flow around a traffic circle being opposite to the rotational direction of traffic flow around a development circle, wherein certain parts of the traffic lane and certain parts of the combination parking and bicycle lane of each traffic circle overlap certain parts of the traffic lanes and certain parts of the combination parking and bicycle lanes of at least two immediately adjacent development circles, wherein said certain overlapping parts of the traffic lanes and the combination parking and bicycle lanes of the traffic circles, and the opposite rotational directions of traffic flow around the traffic circles and around the development circles, provide alternating one-way traffic on all subdivision streets;

and wherein said development circles comprise pervious concrete, and are graded downwardly from the centroid of each development circle, into the park/playground areas, such that the storm water is directed from the development circles and toward said park/playground areas for absorption into the soil.

2. The system defined in claim 1 wherein, as viewed from above the system, the auto traffic around the development circles proceeds clockwise and the auto traffic around the traffic circles proceeds counter-clockwise.

3. The system defined in claim 1 wherein, as viewed from above the system, the auto traffic around the development circles proceeds counter-clockwise and the auto traffic around the traffic circles proceeds clockwise.

4. The system defined in claim 1 wherein entrances into, and exits from, the subdivision comprise parallel curved one-way traffic lanes and combination parking and bicycle lanes separated by planted traffic lane dividers.

5. The system defined in claim 1 wherein entrances into, and exits from, the subdivision comprise mirror-image curved one-way traffic lanes and combination parking and bicycle lanes separated by planted traffic lane dividers.

6. The system defined in claim 1 wherein entrances into, and exits from, the subdivision comprise parallel straight one-way traffic lanes and combination parking and bicycle lanes separated by planted traffic lane dividers.

7. The system defined in claim 1 wherein the peripheral one-way streets are proceeding tangentially in a curved line, having radii equal to the radii of the streets surrounding the traffic circles in the subdivision, from the outer edge of the traffic lane surrounding a development circle to the outer edge of the traffic lane surrounding the adjacent development circle.

8. The system defined in claim 1 wherein the peripheral one-way streets are proceeding tangentially in a straight line from the outer edge of the traffic lane surrounding a development circle to the outer edge of the traffic lane surrounding the adjacent development circle.

9. The system defined in claim 1 wherein the spaces between the central outer edges of the traffic lanes surrounding adjacent development circles are being separated by planted traffic dividers.

10. The system defined in claim 1 wherein lots are consisting of quadrants of a development circle, with the centerline of each such quadrant pointed toward the center of such quadrant's adjacent traffic circle.

11. The system defined in claim 1 wherein the radius of the circle forming the inner edge of the parking lane is reduced, increasing the width of the parking lane and correspondingly reducing the area of the development circle, providing for appropriate angular rather than parallel vehicular parking, thereby permitting office, commercial, industrial and more dense residential usage of the remaining portion of the development circle.

12. The system defined in claim 1 wherein the circles are circular in configuration.

13. The system defined in claim 1 wherein the circles are elliptical in configuration.

14. The system defined in claim 1 wherein the circles are polygonal in configuration.

15. The system defined in claim 1, further comprising water pervious driveways, sidewalks and streets that drain downward into said playgrounds and parks.

* * * * *